United States Patent [19]

Arthur et al.

[11] Patent Number: 4,618,339

[45] Date of Patent: Oct. 21, 1986

[54] CONVEYING CONTINUOUS FILTER MATERIAL

[75] Inventors: Hugh M. Arthur; Graham H. Bates, both of High Wycombe, United Kingdom

[73] Assignee: Molins PLC, Great Britain

[21] Appl. No.: 635,928

[22] Filed: Jul. 30, 1984

[30] Foreign Application Priority Data

Aug. 2, 1983 [GB] United Kingdom ..... 8320817

[51] Int. Cl.[4] ..... B31C 13/00

[52] U.S. Cl. ..... 493/4; 493/49; 131/84.1; 156/356

[58] Field of Search ..... 493/4, 49; 156/441, 156/356, 461, 578; 131/280, 906, 84.1

[56] References Cited

U.S. PATENT DOCUMENTS 3,865,016 2/1975 Greve ..... 493/4

4,511,420 4/1985 Arthur ..... 493/4

FOREIGN PATENT DOCUMENTS 765963 1/1957 United Kingdom .

1343848 1/1974 United Kingdom .

*Primary Examiner*—Francis S. Husar

*Assistant Examiner*—David B. Jones

*Attorney, Agent, or Firm*—Antonelli, Terry & Wands

[57] ABSTRACT

In apparatus for conditioning filter tow for subsequent production of cigarette filter rod a stream of filter tow is conveyed from a source by a first drive unit which delivers the tow into a conditioning station. A second drive unit delivers the conditioned tow to a rod-forming unit. A variable speed transmission is provided to allow independent control of the first and second drive units. The transmission may be replaced by an electronic speed control arrangement.

19 Claims, 1 Drawing Figure

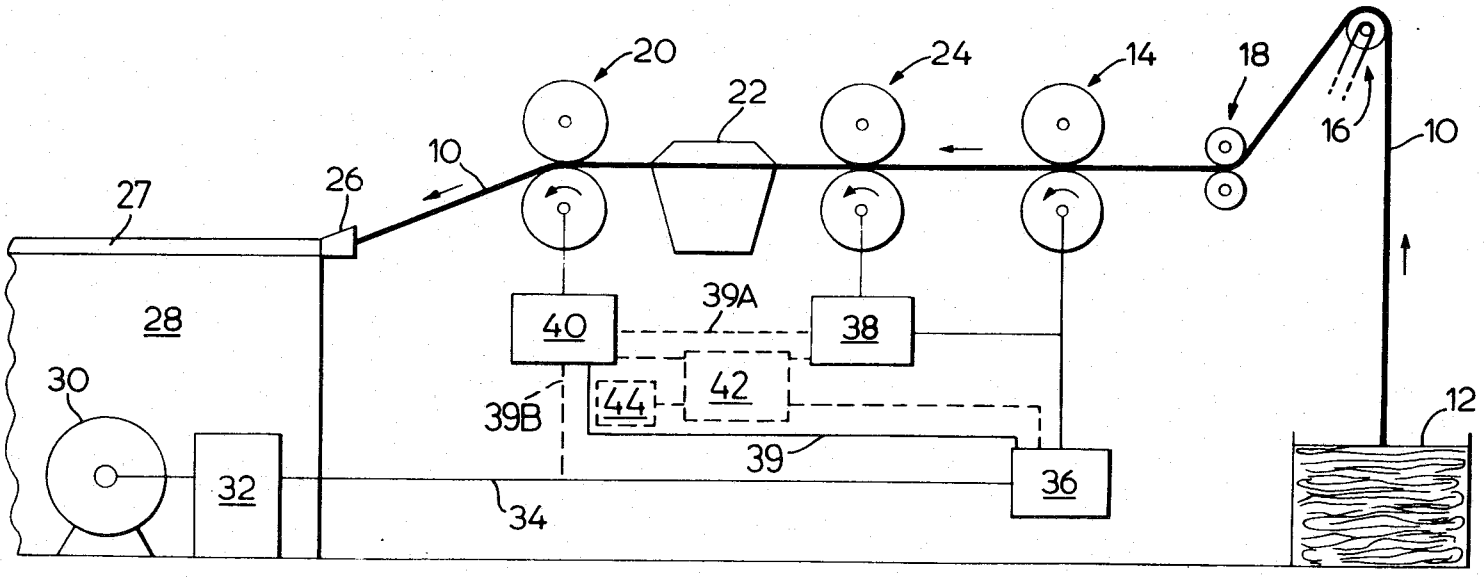
10
12
16
18
14
24
22
20
10
26
27
28
30
32
34
36
38
39
39A
39B
40
42
44

CONVEYING CONTINUOUS FILTER MATERIAL

BACKGROUND OF THE INVENTION

This invention is concerned with conveying continuous filter material, particularly filter material used in the manufacture of continuous filter rod of the tobacco industry.

It is known to deliver continuous filter material, e.g. crimped celullose acetate filter tow, from a bale or other source through conditioning apparatus, e.g. a tow opening device, to a further processing apparatus, e.g. a machine for converting the material into a continuous filter rod. In the conditioning apparatus the material may be moved past a plurality of conveying means which move at different speeds. The conveying means engage the filter material and, due to their different speeds, tend to stretch the material or allow it to contract under its own elasticity. Such as arrangement is commonly used to open or bloom crimped filter tow. The conditioning apparatus may also include a chamber or other device for applying plasticiser to the filter material. A typical conditioning apparatus of this type is Molins T05 machine and typical further processing apparatus comprises Molins PM5N filter rod making machine.

The conditioning apparatus may include first conveying means driven at an appropriate speed to withdraw and meter the filter material from its source, and second conveying means driven at an appropriate speed to deliver the material to the processing apparatus. The first and second conveying means may operate at different speeds and means may be provided for adjusting or setting these speeds. In a conventional arrangement the first and second conveying means are driven from the main drive of the processing apparatus by means of a variable speed transmission. This includes first means for varying the speed of the first and second conveying means and second means for varying the speed of the first conveying means. Thus it is possible to vary the overall speed of the conditioning apparatus relative to that of the processing apparatus, and also to vary the speed of the first conveying means relative to that of the second conveying means. The known arrangement has the disadvantage, however, that adjustment of the first varying means to change the speed of the second conveying means, which controls delivery to the processing apparatus, will also change the speed of the first conveying means, which meters the material into the conditioning apparatus, so that it is necessary to make a further adjustment of the second varying means if it is required to maintain the speed of the first conveying means. This can be an inconvenience, particularly when setting up the conditioning apparatus for a new type of filter material. A further disadvantage of this known drive arrangement is that the tension of the filter material between the first and second conveying means cannot be primarily controlled without affecting the speed of the first conveying means.

SUMMARY OF THE INVENTION

According to one aspect of the present invention there is provided apparatus for conveying continuous filter material of the tobacco industry, particularly cigarette filter tow, in which the material is delivered to processing apparatus, e.g. a filter rod making machine, including first conveying means for withdrawing material from a source and for delivering it to a conditioning station, second conveying means for receiving the material from the conditioning station and for feeding it towards the processing apparatus, means for operating the first and second conveying means at speeds related to that of the processing apparatus, and control means for varying the speed of the second conveying means independently of that of the first conveying means.

The control means may be capable of directly varying the ratio of the speeds of the first and second conveying means. The control means may include speed varying means for one or both of said first and second conveying means. The first and second conveying means may each include independent prime movers and the control means may be capable of adjusting their speeds independently. For example, the control means could include speed sensing means (e.g. tachogenerators) associated with the first and second conveying means (or their prime movers) and circuit means for comparing the speed with a variable preset value. The control means could further include means for adjusting the speed of the relevant prime mover so that any difference in speed detected by the circuit comparing means tends to zero.

In another preferred arrangement the first and second conveyor means are connected to a common prime mover by a transmission. The common prime mover may be a main motor of the processing apparatus. The control means may be incorporated in said transmission, which may include a first variable ratio device for varying the speed of the first conveying means and a second variable ratio device for varying the speed of the second conveying means. The second variable ratio device could be arranged in series or in parallel with said first device.

The conditioning station may further comprise intermediate conveying means located between said first and second conveying means. The control means may include means for varying the speed of the intermediate conveying means. The means for varying the speed of the intermediate conveying means may be arranged in series with first speed varying means for varying the speed of the first conveying means.

The processing apparatus may comprise a filter rod making machine. The conditioning station may comprise tow opening or blooming apparatus, and may include pairs of threaded rolls (as used in conventional tow opening apparatus), which constitute said first and intermediate conveying means, and delivery rolls, which constitute said second conveying means. The filter material may pass through an applicator chamber in which plasticiser or other fluid additive is applied to the material, which may be located between the first and second conveying means. Where intermediate conveying means are provided the chamber is preferably located between the intermediate conveying means and the second conveying means.

The invention allows the tension in the filter material between the first and second conveying means to be controlled without affecting the metering rate of the material as determined by the speed of the first conveying means. Particularly where the filter material is crimped filter tow and a plasticiser applicator station is located between the first and second conveying means this allows optimisation of plasticiser application without excessive stretching by maintaining just sufficient tension in the material.

According to another aspect of the invention a method of conveying continuous filter material between a source and a rod making unit comprises the steps of conveying the material at a first speed between the source and a conditioning station, applying a treatment to the material in the conditioning station, conveying the material at a second speed between the conditioning station and the rod making unit, varying the first and second speeds according to the rate of the rod making unit, and varying the second speed independently of the first speed, so as to control the tension of the material in the conditioning station without affecting the rate of withdrawal of the material from the source.

BRIEF DESCRIPTION OF THE DRAWNGS

The invention will be further described, by way of example only, with reference to the accompanying diagrammatic drawing.

DESCRIPTION OF THE PRFERRED EMBODIMENT

A continuous filter tow 10 is withdrawn from a bale 12 by a first pair of driven rolls 14. The tow 10 passes to the rolls 14 over a boom 16 and through pretension rolls 18. The rolls 14 are preferably threaded rolls having a series of small pitch threaded grooves, and as used for example on Molins T05 machine. A second pair of driven rolls 20 is arranged downstream of the first pair of rolls 14 and serves to draw the tow 10 through a plasticiser chamber 22, in which plasticiser is applied to the tow, and from an intermediate pair of driven rolls 24. The rolls 24 are similar to the rolls 14. From the rolls 20 the tow passes to a converging horn or guide 26 and rod forming unit 27 of a filter rod making machine 28.

The filter rod making machine 28 includes a main motor 30, for conveying the tow and other materials (e.g. a paper wrapper) through the unit 27, and a transmission 32, which includes a driven output connection 34 leading to a first positively infinitely variable ratio device (PIV) 36. The output of the PIV 36 is connected to the first rolls 14 and also, by way of a connection 39, to a second PIV 40, the output of which is connected to the rolls 20. A further PIV 38 is connected between the first PIV 36 and the intermediate rolls 24.

The rolls 14 feed or meter tow 10 from the bale 12 into the apparatus. The rolls 24 rotate at a higher speed than the rolls 14 and stretch or bloom the tow 10. The rolls 20 deliver tow to the rod making machine 28 and, since they rotate more slowly than the rolls 24, allow the tow tension to relax while maintaining sufficient tension for feeding the tow through the plasticiser chamber 22. If the rod speed of the machine 28 is V then typical values for the speeds of the rolls 14, 24 and 20, as determined by the PIV's 36, 38 and 40 are:

rolls 14—0.9V
rolls 24—1.4V
rolls 20—1.05V

In use the speeds of the rolls 14, 24 and 20 vary with the speed of the main motor 30. The rate at which tow is fed from the bale 12 is determined principally by the speed of the first rolls 14 and, for a given speed of motor 30, this is determined by the PIV 36. Variation or adjustment of the ratio of the PIV 36 does not affect the relative speeds of the rolls 14, 24 and 20, so that the treatment of the tow upstream of the machine 28 may be largely unaffected by changes of speed of that machine. Similarly, it is possible to change the speed of rolls 24, i.e. to alter the stretch ratio, by adjusting the PIV 38, and/or to change the speed of the delivery rolls 20 by adjusting the PIV 40, without affecting the speed and feed rate of the rolls 14.

The PIV 40 may be connected for drive from the output of the PIV 38 or directly from the line 34, as indicated respectively by the drive connections 39A and 39B in the drawing. Both of these arrangements still retain the advantage that the relative speeds of the delivery rolls 20 and rod making machine 28 can be varied, to allow the crimp in the tow to recover and/or to retain correct feeding into the guide 26, without affecting the metering of the tow by the rolls 14. The tension of the tow in the region between the rolls 24 and 20 may therefore be controlled, so as to optimise the application of plasticiser and the performance of the tow, without affecting the metering rate of the rolls 14. The tension is preferably maintained at a level which is just sufficient to maintain relative tautness through the plasticiser chamber 22 and so that minimum loss of crimp in the tow is caused.

In an alternative arrangement, the PIV's 36, 38, and 40 are replaced by units 36, 38, and 40 each incorporating a prime mover and associated circuitry under control of a circuit 42. The circuit 42 and the circuits incorporated with the prime movers 36, 38, and 40 could comprise one or more microprocessors. The circuits incorporated within the units 36, 38, and 40 may include means for sensing the speeds of the respective rolls 14, 24, and 20, and the circuit 42 may include means for comparing the detected speeds with a preset value. Means 44 may be provided for varying the preset value. The arrangement is such that the rolls 14, 24, and 20 are driven at the appropriate speeds under electronic rather than mechanical connections. One way in which the speeds of separate motors may be controlled electronically is disclosed in British patent specification No. 2059245. In other respects the performance and advantages of the drive arrangement having PIV's is achieved in a similar manner.

In a further alternative arrangement any of the previously described arrangements could be used with any controllable conveying unit for the tow, which may replace one or more of the pairs of rolls 14, 20, and 24. In particular, one or more conveying units which at least partially use pressure air to convey the tow may replace the rolls 14, 20 and/or 24, and the units 36, 38, and/or 40 may be used at least partially to control the pressure air. An example of a tow conveying unit pressure air is described in U.S. Pat. No. 4,435,239. In this alternative arrangement, and in general, reference herein to speed or rate of a conveying means for filter material should be regarded as including a reference to the speed or rate of the material conveyed by the conveying means.

We claim:

1. Apparatus for conveying continuous filter material of the tobacoo industry between a source of said material and a rod-making machine, including first conveying means for withdrawing material from said source, a conditioning station arranged to receive material from said first conveying means, driven second conveying means for receiving material from the conditioning station and for feeding it towards the rod-making machine, means for operating the first and second conveying means at speeds related to that of the rod-making machine, and control means for varying the speed of the second conveying means independently of that of the first conveying means, whereby passage of material through the conditioning station may be controlled independently of rate of withdrawal of material from said source.

2. Apparatus as claimed in claim 1, wherein the control means is arranged to directly vary the ratio of the speeds of the first and second conveying means.

3. Apparatus as claimed in claim 1, wherein the control means comprises speed varying means for each of said first and second conveying means.

4. Apparatus as claimed in claim 1, wherein the control means includes means associated with said second conveying means for sensing speed and for comparing the speed detected with a selectively adjustable preset value.

5. Apparatus as claimed in claim 4, wherein the control means includes means for adjusting the speed of said conveying means so that any difference in speeds compared by said circuit means tends to zero.

6. Apparatus as claimed in claim 1, wherein the first and second conveying means include separate prime movers.

7. Apparatus as claimed in claim 2, including a common prime mover and a transmission connecting said common prime mover to said first and second conveying means.

8. Apparatus as claimed in claim 7, wherein the transmission incorporates said control means.

9. Apparatus as claimed in claim 8, wherein the transmission includes a first variable ratio device for varying the speed of the first conveying means and a second variable ratio device for varying the speed of the second conveying means.

10. Apparatus as claimed in claim 9, wherein the first and second variable ratio devices are arranged in series.

11. Apparatus as claimed in claim 1, wherein the conditioning station includes means for applying a fluid additive to the filter material.

12. Apparatus as claimed in claim 1, wherein the conditioning station includes intermediate conveying means, located between said first and second conveying means.

13. Apparatus as claimed in claim 12, wherein the control means includes means for varying the speed of the intermediate conveying means.

14. Apparatus as claimed in claim 13, wherein the means for varying the speed of the intermediate conveying means is arranged in series with first speed varying means for varying the speed of the first conveying means.

15. A method of conveying continuous filter material between a source and a rod making unit, comprising the steps of conveying the material at a first speed between the source and a conditioning station, applying a treatment to the material in the conditioning station, conveying the material by driven means at a second speed between the conditioning station and the rod making unit, varying the first and second speeds according to the rate of the rod making unit, and varying the second speed independently of the first speed, so as to control the tension of the material in the conditioning station without affecting the rate of withdrawal of the material from the source.

16. Apparatus for conveying continuous filter material of the tobacco industry between a source of said material and a rod-making machine, including first conveying means for withdrawing material from said source, a conditioning station arranged to receive material from said first conveying means, driven second means for receiving material from the conditioning station and for feeding it towards the rod-making machine, means for operating the first conveying means at a predetermined first speed related to the speed of the rod-making machine, and means for varying the tension of material passing through the conditioning station, said varying means including control means for varying the speed of the second conveying means independently of that of the first conveying means.

17. Apparatus as claimed in claim 16, wherein said means for operating said first conveying means at a predetermined first speed includes a first variable speed device and said control means includes a second variable speed device.

18. Apparatus as claimed in claim 17, wherein said first and second variable speed devices are arranged in series.

19. A method of conveying continuous filter material between a source and a rod-making unit, comprising the steps of conveying the material at a first speed between the source and a conditioning station, applying a treatment to the material in the conditioning station, conveying the material at a second speed between the conditioning station and the rod-making unit by driven means, varying the first and second speeds according to the rate of the rod-making unit, and controlling the tension in the conditioning station by varying the second speed independently of the first speed.

* * * * *